US011441402B2

(12) United States Patent
Alkafeef

(10) Patent No.: US 11,441,402 B2
(45) Date of Patent: Sep. 13, 2022

(54) METHOD FOR IN-SITU TAR MAT REMEDIATION AND RECOVERY

(71) Applicant: GIFTEDNESS AND CREATIVITY COMPANY, Safat (KW)

(72) Inventor: Saad F. Alkafeef, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 17/588,735

(22) Filed: Jan. 31, 2022

(65) Prior Publication Data

US 2022/0243571 A1 Aug. 4, 2022

Related U.S. Application Data

(60) Provisional application No. 63/143,818, filed on Jan. 30, 2021.

(51) Int. Cl.

| | |
|---|---|
| ***E21B 43/24*** | (2006.01) |
| ***C10G 21/00*** | (2006.01) |
| ***E21B 43/30*** | (2006.01) |

(52) U.S. Cl.

CPC ..... *E21B 43/24* (2013.01); *C10G 21/003* (2013.01); *E21B 43/305* (2013.01); *C10G 2300/206* (2013.01)

(58) Field of Classification Search

CPC ..... E21B 43/24; E21B 43/305; C10G 21/003; C10G 2300/206

See application file for complete search history.

(56) References Cited

U.S. PATENT DOCUMENTS

| | | | | |
|---|---|---|---|---|
| 4,341,622 | A | 7/1982 | Tabak et al. | |
| 4,522,710 | A | 7/1985 | Achia et al. | |
| 4,673,485 | A | 6/1987 | Bristow et al. | |
| 4,765,883 | A | 8/1988 | Johnson et al. | |
| 5,685,972 | A | 11/1997 | Timken et al. | |
| 7,347,051 | B2 | 3/2008 | Christensen | |
| 9,469,816 | B2 | 10/2016 | Iqbal et al. | |
| 2011/0094937 | A1 | 4/2011 | Subramanian et al. | |
| 2014/0360727 | A1* | 12/2014 | Milam | C09K 8/524 166/52 |
| 2016/0230522 | A1* | 8/2016 | Daniel | C09K 8/592 |

FOREIGN PATENT DOCUMENTS

EP 0893487 B1 1/2007

OTHER PUBLICATIONS

"Residuum Oil Supercritical Extraction (ROSE)" Brochure, © 2007 Kellogg Brown and Root LLC.

* cited by examiner

*Primary Examiner* — Randy Boyer
*Assistant Examiner* — Juan C Valencia
(74) *Attorney, Agent, or Firm* — Nath, Goldberg & Meyer; Richard C. Litman

(57) ABSTRACT

A method for in-situ remediation and recovery of a tar mat TM layer of a sub-surface formation can include deasphalting oil obtained from an oil column to produce a deasphalted oil, extracting an aromatic solvent from the deasphalted oil to provide a residual deasphalted oil and an extracted solvent; and injecting the residual deasphalted oil and the extracted solvent into the tar mat TM layer of the sub-surface formation using at least one horizontal well selected from the group consisting of a single horizontal well, two parallel horizontal wells, and a plurality of horizontal wells arranged in a radial configuration.

17 Claims, 8 Drawing Sheets

METHOD FOR IN-SITU TAR MAT REMEDIATION AND RECOVERY

RELATED APPLICATIONS

The present patent application claims priority to provisional U.S. Patent Application No. 63/143,818 filed Jan. 30, 2021, which is incorporated by reference herein in its entirety.

1. FIELD

The disclosure of the present patent application relates to improving oil well production, and particularly, to a method for in-situ tar mat remediation and recovery.

2. DESCRIPTION OF THE RELATED ART

Tar mats are extra heavy oil zones sandwiched between aquifers and adjoining oil columns that isolate an oil reservoir from its aquifer column either partially or completely. The mechanisms that result in the formation of tar mats in petroleum reservoirs have been debated for many years. Recent geochemical studies indicate that tar-mats originally form as a result of one or more of the following mechanisms: (1) gravitational segregation that cause heavier hydrocarbons to move downwards and lighter hydrocarbons to move upwards; (2) natural deasphalting which entails natural gases entering from the source rock and rising through the hydrocarbon column due to buoyancy, resulting in reduced solubility of the asphaltic fraction, which consequently precipitate asphaltenes at the base of the reservoir; (3) water washing which entails removal of a portion of the light hydrocarbons, positioning the asphaltic fraction at the foundation of oil accumulation; (4) biodegradation which entails movement of meteoric water beneath the pooled reservoir and transmitting bacteria that metabolizes the crude oil's lighter fraction.

Regardless of how they form, immobile asphaltic layers or tar mats can be very damaging to the production of oil because they generally prevent aquifer column pressure from supporting oil production. The tar mat is typically found at the oil/water contact in these reservoirs, forming sealing barriers that isolate oil reservoirs from their aquifer pressure drive. FIG. 6 is a perspective diagram 600 of a tar mat TM positioned between an aquifer column AC and an oil column OC. One kind of tar mat TM has a large and discontinuous increase in asphaltene content versus depth in the oil column OC. This type of tar mat corresponds to a colloidal instability or a phase transition of asphaltenes. As a result, flow assurance problems are often encountered during oil production from a conventional oil well OW, especially when gas injection processes are used. The second kind of tar mat TM forms at the base of a heavy oil column OC. With respect to the production of oil, these two types of tar mats are generally operationally identical. It is believed that remediation of a single oil field could result in more than 2 billion extra of barrels of extra oil being produced from the oil wells in the field.

Thus, a method for in-situ tar mat remediation and recovery solving the aforementioned problems is desired.

SUMMARY

A method for in-situ remediation and recovery of a tar mat TM layer of a sub-surface formation can include deasphalting oil obtained from an oil column to produce a deasphalted oil, extracting an aromatic solvent from the deasphalted oil to provide a residual deasphalted oil and an extracted solvent; and injecting the residual deasphalted oil and the extracted solvent into the tar mat TM layer of the sub-surface formation using at least one horizontal well selected from the group consisting of a single horizontal well, two parallel horizontal wells, and a plurality of horizontal wells arranged in a radial configuration.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

A method for in-situ remediation and recovery of a tar mat TM layer of a sub-surface formation can include deasphalting crude oil obtained from an oil column to produce a deasphalted oil, extracting an aromatic solvent from the deasphalted oil to provide a residual deasphalted oil (the term 'a residual deasphalted oil' is defined herein and henceforth to mean a raffinate from a solvent extracted from deasphalted crude oil) and an extracted solvent; and injecting the residual deasphalted oil and the extracted solvent into the tar mat TM layer of the sub-surface formation using at least one horizontal well. The horizontal well can extend horizontally into the tar mat TM layer. The horizontal well can be selected from the group consisting of a single horizontal well, two parallel horizontal wells, and a plurality of horizontal wells arranged in a radial configuration. The horizontal well can include temperature and pressure sensors generally known in the art for use in smart wells. The extracted solvent can include one or more aromatic solvents selected from benzene, toluene, xylene, cymene, and cumene.

Figure 6:
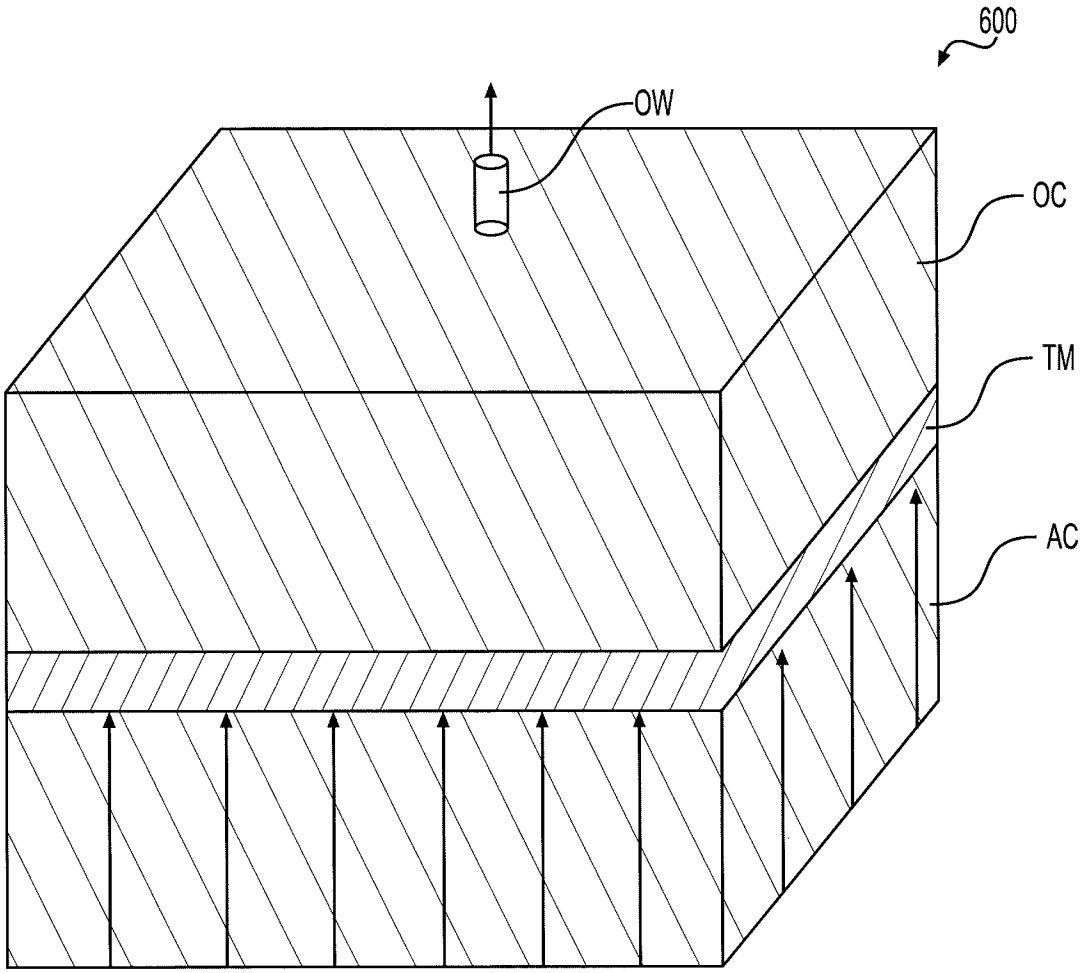
FIG. 6 (PRIOR ART)
FIG. 6 is a perspective diagram of a tar mat between an aquifer column and an oil column.

As shown in FIG. 6, the tar mat TM layer can be between an aquifer column AC and the oil column OC. Tar mat TM layer can be an extra heavy oil zone sandwiched between an aquifer and an adjoining oil column. The presence of high viscosity tar mats can result in rapid pressure drops in the oil column. Once injected into the tar mat TM layer, as described herein, the extracted solvent and residual deasphalted oil can have a level of solvency sufficient to improve, e.g., decrease, the viscosity of the tar mat TM layer. By decreasing the viscosity of the tar mat layer TM, the tar mat layer TM can be remediated to reinstate the aquifer pressure drive for supporting oil production. The methods described herein are not limited to tar mat radiation and can be applied to remediation of asphaltene deposition in oil well tubing and near well bores.

Figure 1:
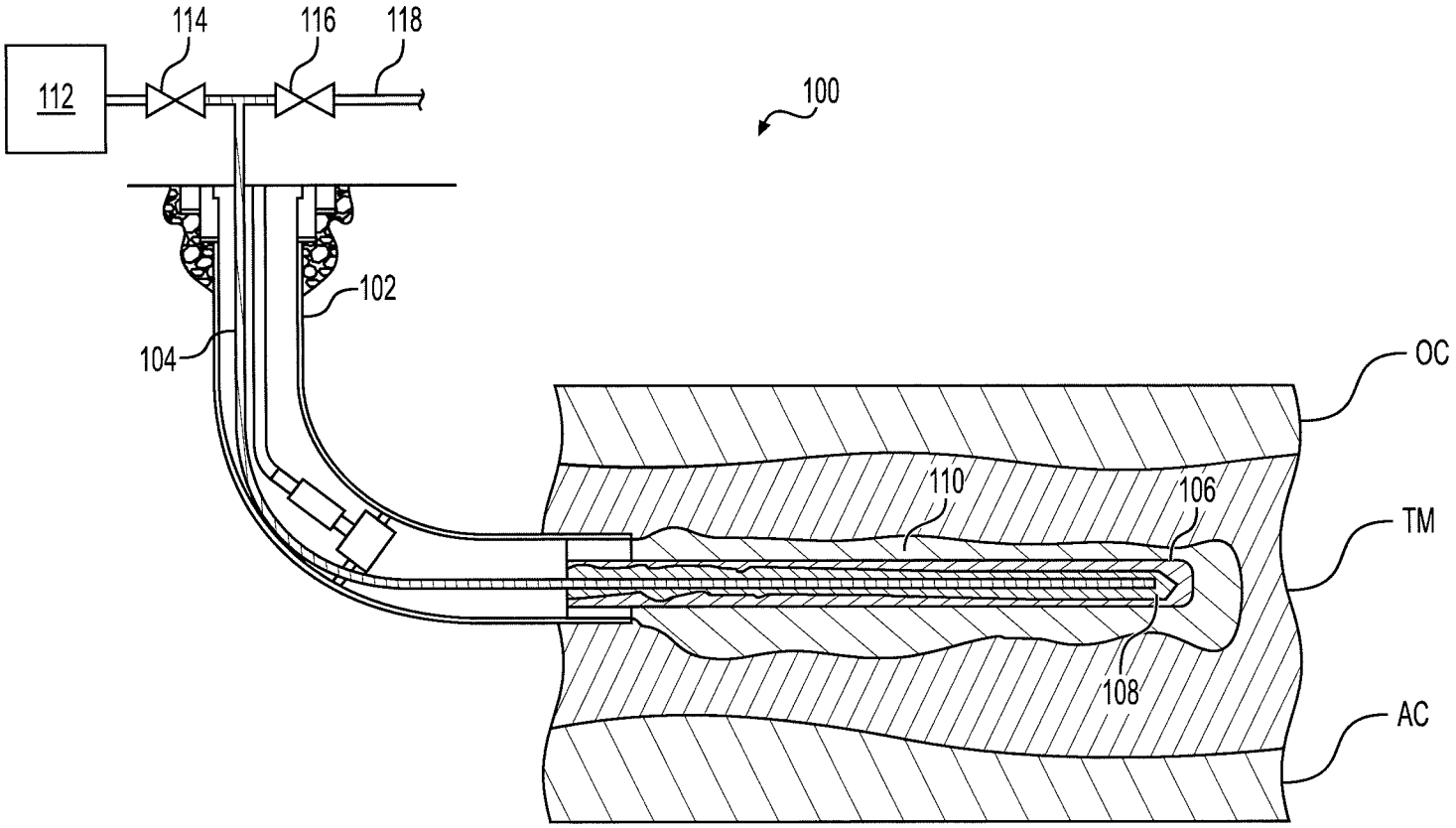
FIG. 1 is a side view of a smart horizontal well for in-situ tar mat remediation and recovery with one horizontal well.

In an embodiment, the horizontal well is a single horizontal well 100, as shown in FIG. 1. The single horizontal well 100 can include a single well bore 102 and at least one well tube 104 disposed within the well bore 102. The well bore 102 can be generally L-shaped, having a vertical portion extending through the oil column to the tar mat TM and a horizontal portion extending horizontally from the vertical portion through the tar mat TM. An input valve 114 connects the proximate end of the well tube 104 with a pressurized source of the extracted solvent and residual deasphalted oil 112. The tube 104 has a distal end 108 disposed within a diffuser tube 106 in the well bore 102. The single horizontal well 100 includes temperature and pressure sensors (not shown) within the well bore 102. An optimal ratio of extracted solvent to residual deasphalted oil for injecting into the tar mat TM can be determined in situ, as described herein. The solvent and residual deasphalted oil can be distributed into the tar mat TM using the diffuser tube 106, which results in a portion of the tar mat being dissolved to form dissolved products 110. In an embodiment, the dissolved products 110 can be recovered by closing the input valve 114 so that the dissolved products 110 are directed to an output valve 116 through the proximate end of the well tube 104 to an outlet 118.

Figure 2:
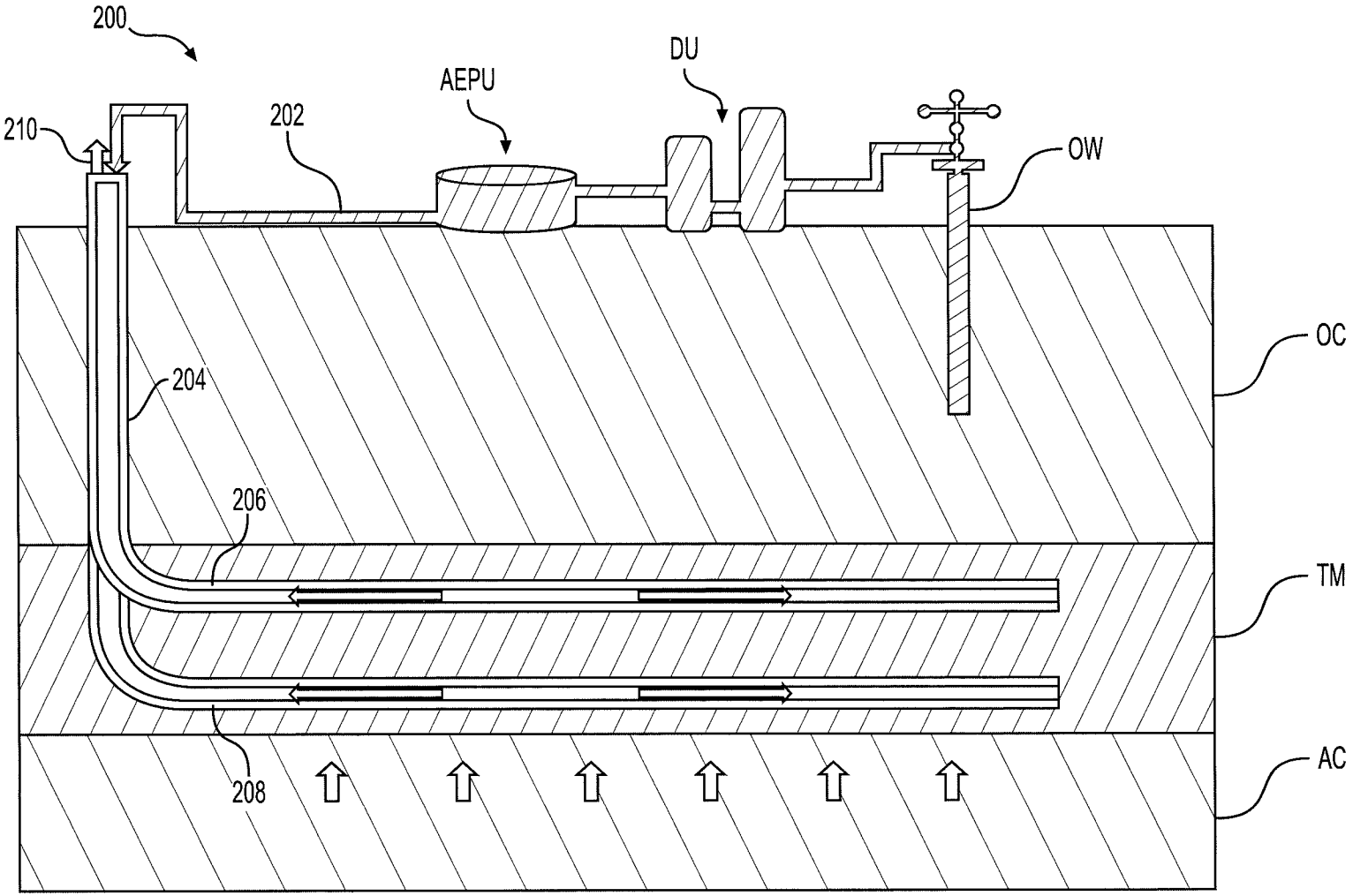
FIG. 2 is a side view of a system for in-situ tar mat remediation and recovery with two parallel horizontal wells.

FIG. 2 is a side view of a system 200 for in-situ tar mat remediation and recovery. In system 200, the diluted extracted solvent and residual deasphalted oil is provided via a supply pipe 202. Crude oil is obtained from the reservoir oil column OC using an oil well OW and is deasphalted, preferably on-site, using a suitable deasphalting unit DU. The aromatic solvent is extracted from the deasphalted oil using a suitable aromatics extraction and purification unit AEPU that is also preferably on site. The extracted aromatic solvent and residual deasphalted oil are then provided to a main well bore 204 through supply pipe 202. An upper well 206 and a lower well 208 extend into the tar mat TM from the main wellbore 204. An extraction pipe 210 is provided to remove dissolved products from the main wellbore 204. An input valve (not shown, but similar to valve 114 of FIG. 1) selectively connects input pipe 202 to the main wellbore 204, while an output valve (not shown, but similar to valve 116 of FIG. 1) selectively connects the extraction pipe 210 to the main wellbore 204. Both wells 206, 208 can be used to both deliver the extracted solvent and residual deasphalted oil and to extract the dissolved products. In some embodiments, one of the wells 206, 208 can be used to deliver the extracted solvent and residual deasphalted oil, while the other well 208 can be used to extract the dissolved products.

Figure 3:
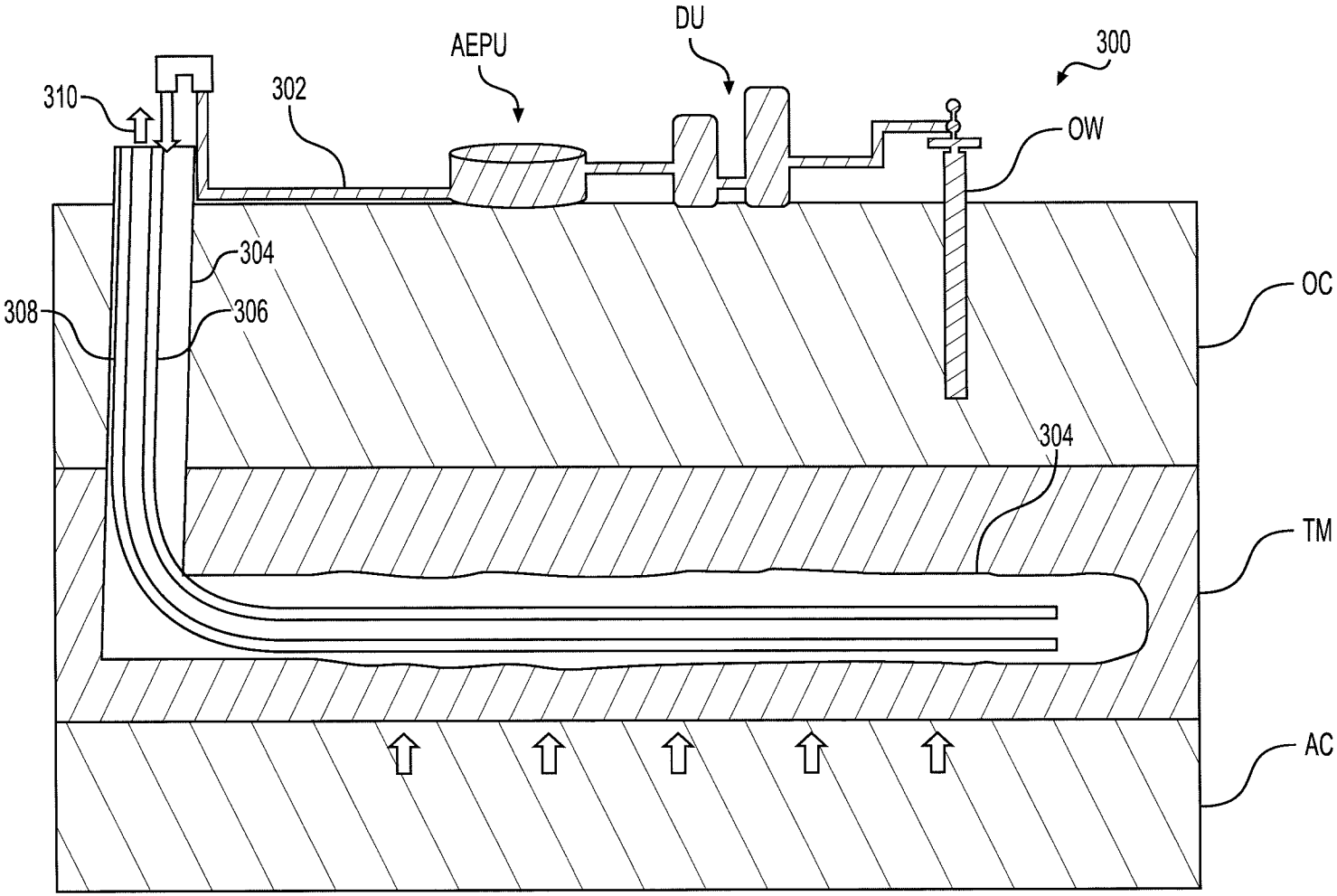
FIG. 3 is a side view of a system for in-situ tar mat remediation and recovery with one horizontal well and dual tubes.

FIG. 3 is a side view of a system 300 with two tubes for in-situ tar mat remediation and recovery. In system 300, the extracted solvent and residual deasphalted oil are provided via a supply pipe 302. Crude oil is obtained from the reservoir oil column OC using an oil well OW and is deasphalted, preferably on-site, using a suitable deasphalting unit DU. The aromatic solvent can be extracted from the deasphalted oil using a suitable aromatics extraction and purification unit AEPU that is also preferably on site. The extracted solvent and residual deasphalted oil are then provided to supply pipe 302. The system 300 includes a main wellbore 304. An upper tube 306 and a lower tube 308 extend within the main wellbore 304. An extraction pipe 310 is provided to remove dissolved products from the tubes 306, 308. A first input valve (not shown, but similar to valve 114 of FIG. 1) selectively connects the input pipe 302 to the upper tube 306, while a first output valve (not shown, but similar to valve 116 of FIG. 1) selectively connects the extraction pipe 310 to the upper tube 306. A second input valve (not shown, but similar to valve 114 of FIG. 1) selectively connects the input pipe 302 to the lower tube 308, while a first output valve (not shown, but similar to valve 116 of FIG. 1) selectively connects the extraction pipe 310 to the lower tube 308. Both tubes 306, 308 can be used to both deliver the extracted solvent and residual deasphalted oil and to extract the dissolved products. In some configurations, one of the tubes 306, 308 can be used to deliver the extracted solvent and residual deasphalted oil, while the other one of tubes 306, 308 can be used to extract the dissolved products.

Figure 4:
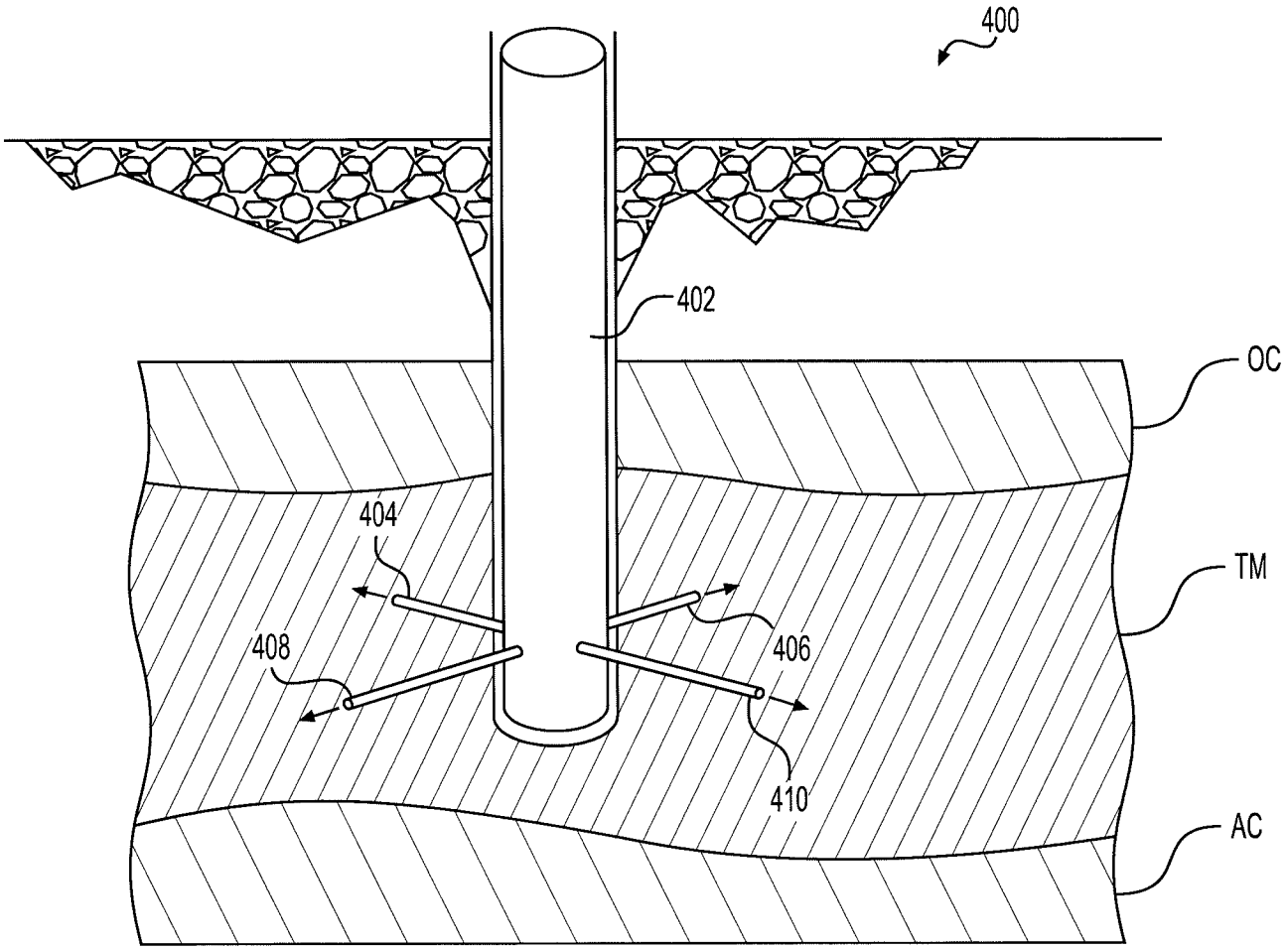
FIG. 4 is a perspective view of a system for in-situ tar mat remediation and recovery with four horizontal wells arranged in a radial pattern.

FIG. 4 is a perspective view of a system 400 for in-situ tar mat remediation and recovery. The system 400 includes: a main vertical wellbore 402; a first horizontal well 404 extending horizontally from a first position of the main vertical wellbore 402; a second horizontal well 406 extending horizontally from a second position of the main vertical wellbore 402; a third horizontal well 408 extending horizontally from a third position of the main vertical wellbore 402; and a fourth horizontal well 410 extending horizontally from a fourth position of the main vertical wellbore 402. The first, second, third and fourth positions can be horizontally spaced from each other and axially aligned. The horizontal wells 404, 406, 408, and 410 can have a radial arrangement, with wells 406 and 408 extending in opposing directions from each other and wells 404 and 410 extending in opposing directions from each other. This arrangement facilitates equal distribution of the extracted solvent and residual deasphalted oil throughout the tar mat TM layer. The system 400 may include more or less than four horizontal wells, although four wells are shown in FIG. 4. As with previous embodiments, the extracted solvent and residual deasphalted oil are preferably produced on-site from locally extracted crude oil, although it may be supplied from a remote location. An input valve (not shown, but similar to valve 114 of FIG. 1) selectively connects a source of solvent (not shown) to the input pipe connected to the main vertical wellbore 402, while an output valve (not shown, but similar to valve 116 of FIG. 1) selectively connects an extraction pipe (not shown) to the main vertical wellbore 402. As with previous embodiments, multiple input and output valves may be used for independent control of each of the four horizontal wells 404, 406, 408, 410.

Figure 7:
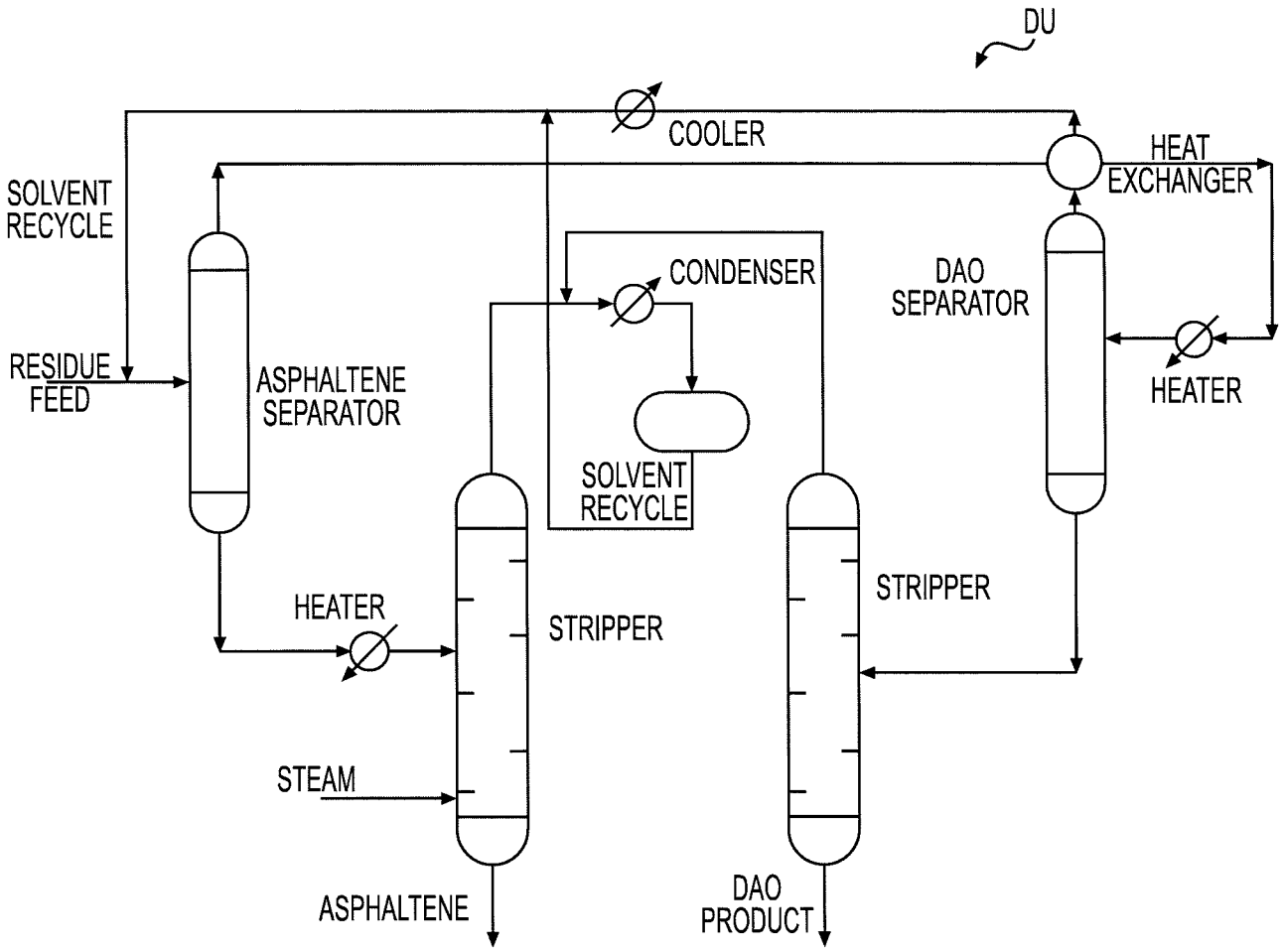
FIG. 7 (PRIOR ART)
FIG. 7 is a schematic diagram of a prior art deasphalting unit that can be used in the method for in-situ tar mat remediation and recovery.
Figure 8:
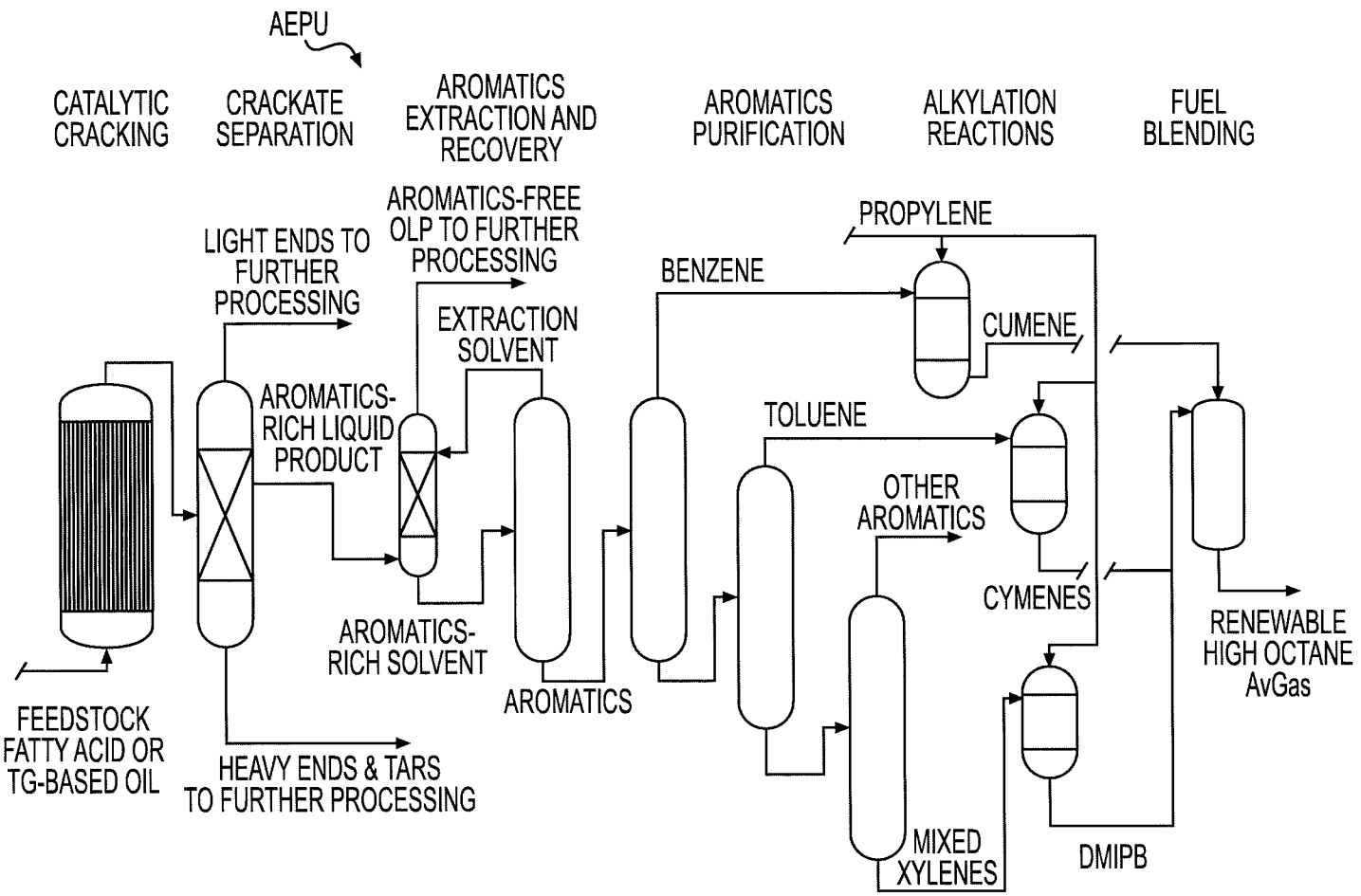
FIG. 8 (PRIOR ART)
FIG. 8 is a schematic diagram of a prior art aromatics extraction and purification unit that can be used in the method for in-situ tar mat remediation and recovery.

The crude oil is preferably obtained from the reservoir oil column OC above the tar mat TM to be remediated. This is to avoid the need to transport the crude oil or the extracted solvent and residual deasphalted oil from a remote source. The crude oil can be deasphalted using any suitable methods known in the art. In an embodiment, a supercritical extraction process can be employed using a suitable extraction system, e.g., KBR Inc.'s ROSE technology. In an embodiment, deasphalting of the crude oil is achieved in the manner set forth in FIG. 7. Extraction of aromatic solvents from the deasphalted oil can be conducted using any suitable technology known in the art, e.g., aromatic fractionation technologies provided by JONELL SYSTEMS. In an embodiment, extraction of the aromatic solvents can be conducted in the manner set forth in FIG. 8. The fraction extracted using the aromatics extraction and purification unit AEPU shown in FIG. 8 can be combined with the residual deasphalted oil to provide a "high power" solvent or a solvent that can significantly minimize the viscosity of the tar mat TM layer. In an embodiment, a viscosity of <5000 cp at 190° F. can be achieved in the tar mat TM layer using the present method. In an embodiment, a viscosity of <500 cp at 190° F. can be achieved in the tar mat TM layer using the present method. A high power solvent can be determined through in-situ experimentation. For example, different solvents having different aromatic solvent to deasphalted oil ratios can be tested to determine an optimal ratio for decreasing viscosity of the tar mat TM layer.

Figure 5:
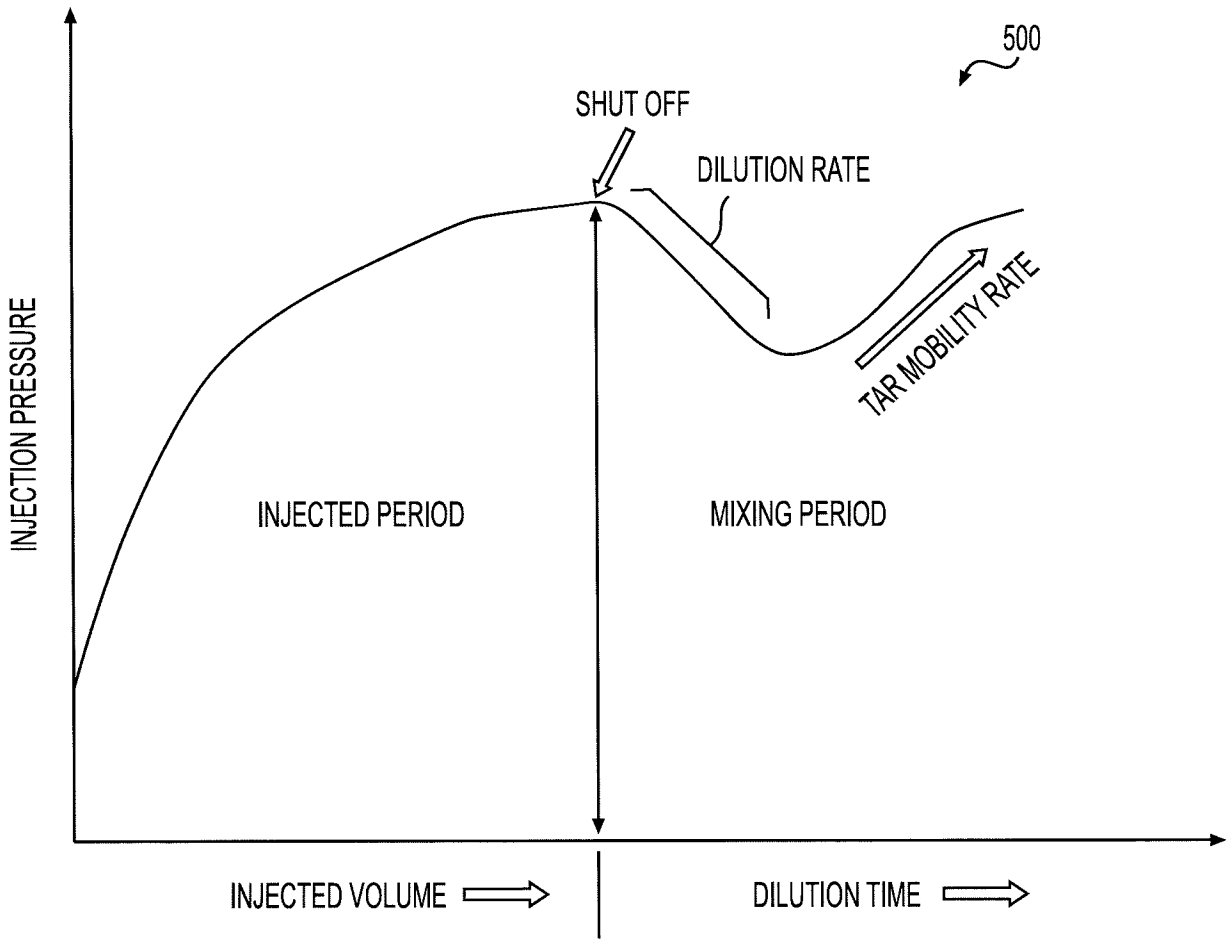
FIG. 5 is a graph of injection pressure during an injection period and a mixing period according to the present teachings.

Once the extracted solvent and residual deasphalted oil are delivered into the tar mat TM layer, the input valve 114 and the output valve 116 are closed to allow mixing with the tar mat TM layer. As can be seen from the graph 500 in FIG. 5, tar mobility rate increases during the mixing period. By monitoring this mobility rate for different solvents having different aromatic solvent to deasphalted oil ratios, an optimal solvent ratio can be determined.

It is to be understood that the method for in-situ tar mat remediation and recovery is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A method for in-situ tar mat remediation, comprising:

injecting an aromatic solvent extracted from deasphalted crude oil and a residual deasphalted crude oil into a tar mat layer using at least one horizontal injection well.

2. The method for in-situ tar mat remediation as recited in claim 1, further comprising the steps of:

extracting crude oil from an oil reservoir above the tar mat layer;

deasphalting the crude oil to provide the deasphalted crude oil; and extracting the aromatic solvent from the deasphalted crude oil.

3. The method for in-situ tar mat remediation as recited in claim 1, wherein the least one horizontal injection well comprises a single horizontal injection well with at least one injection tube.

4. The method for in-situ tar mat remediation as recited in claim 3, wherein the least one injection tube comprises a single injection tube.

5. The method for in-situ tar mat remediation as recited in claim 3, wherein the least one injection tube comprises two injection tubes.

6. The method for in-situ tar mat remediation as recited in claim 1, wherein the least one horizontal injection well comprises two parallel horizontal injection wells.

7. The method for in-situ tar mat remediation as recited in claim 1, wherein the least one horizontal injection well comprises a plurality of horizontal injection wells extending from a main well and arranged in a radial pattern.

8. The method for in-situ tar mat remediation as recited in claim 1, further comprising:

producing dissolved tar mat layer products after injecting the aromatic solvent and the residual deasphalted crude oil into the tar mat layer; and harvesting the dissolved tar mat layer products.

9. The method for in-situ tar mat remediation as recited in claim 1, further comprising:

producing dissolved tar mat layer products after injecting the aromatic solvent and the residual deasphalted crude oil into the tar mat layer; and harvesting the dissolved tar mat layer products.

10. The method for in-situ tar mat remediation as recited in claim 1, wherein a supercritical extraction process is used to deasphalt the crude oil.

11. A method for in-situ tar mat remediation, comprising:

extracting crude oil from an oil reservoir;

deasphalting the crude oil to produce a deasphalted crude oil;

extracting the aromatic solvent from the deasphalted crude oil to provide an aromatic solvent and a residual deasphalted oil; and injecting the aromatic solvent and the residual deasphalted crude oil into a tar mat layer using at least one horizontal injection well.

12. The method for in-situ tar mat remediation as in claim 11, wherein the tar mat layer is beneath the oil reservoir.

13. The method for in-situ tar mat remediation as in claim 11, wherein the at least one horizontal injection well comprises a single injection well with at least one injection tube.

14. The method for in-situ tar mat remediation as in claim 11, wherein the at least one injection tube comprises a single injection tube.

15. The method for in-situ tar mat remediation as in claim 11, wherein the at least one injection tube comprises two injection tubes.

16. The method for in-situ tar mat remediation as in claim 11, wherein the at least one horizontal injection well comprises two parallel injection wells.

17. The method for in-situ tar mat remediation as in claim 11, wherein the at least one horizontal injection well comprises a plurality of horizontal injection wells extending from a main well in a radial pattern.

* * * * *